US006857807B2

(12) United States Patent
Akaishi

(10) Patent No.: US 6,857,807 B2
(45) Date of Patent: Feb. 22, 2005

(54) LIQUID APPLICATOR

(75) Inventor: Tetsuaki Akaishi, Takasaki (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/312,728

(22) PCT Filed: Jun. 14, 2001

(86) PCT No.: PCT/JP01/05074

§ 371 (c)(1),
(2), (4) Date: Feb. 13, 2003

(87) PCT Pub. No.: WO02/01983

PCT Pub. Date: Jan. 10, 2002

(65) Prior Publication Data

US 2003/0156886 A1 Aug. 21, 2003

(30) Foreign Application Priority Data

Jun. 30, 2000 (JP) ..... 2000-199547

(51) Int. Cl.[7] ..... A46B 11/04
(52) U.S. Cl. ..... 401/277; 401/286
(58) Field of Search ..... 401/286, 277, 401/270, 199, 198, 205, 272, 275, 183, 184, 185, 186, 188 A

(56) References Cited

U.S. PATENT DOCUMENTS

| | | | | | |
|---|---|---|---|---|---|
| 3,682,559 | A | * | 8/1972 | Hirota | 401/278 |
| 3,947,136 | A | * | 3/1976 | Adams | 401/188 A |
| 4,279,527 | A | * | 7/1981 | Moe et al. | 401/277 |
| 4,930,923 | A | * | 6/1990 | Reichmann et al. | 401/278 |
| 4,960,340 | A | * | 10/1990 | Tamiya et al. | 401/186 |
| 5,013,361 | A | * | 5/1991 | Case et al. | 106/31.36 |

FOREIGN PATENT DOCUMENTS

| | | |
|---|---|---|
| JP | 49-25520 | 3/1974 |
| JP | 04-010993 A | 1/1992 |
| JP | 7-4073 | 1/1995 |
| JP | 11-020375 A | 1/1999 |
| JP | 11-268471 A | 10/1999 |

* cited by examiner

*Primary Examiner*—David J. Walczak
(74) *Attorney, Agent, or Firm*—Burns, Doane, Swecker & Mathis, L.L.P.

(57) ABSTRACT

A liquid applicator having a predetermined applying part (3) at the front end of a cylindrical main part (2), wherein a liquid squeezing mechanism (4) attached to the main part (2) is caused to push an application liquid (L) having a viscosity of 30 mPa·s to 500 mPa·s stored in the main part (2), forwards so as to feed applying part (3), is constructed so that an application liquid feeder (3*c*) also serving as a liquid leakage preventing structure is arranged between the applying part (3) and the main part (2).

2 Claims, 18 Drawing Sheets

PRIOR ART

PRIOR ART

PRIOR ART

LIQUID APPLICATOR

TECHNICAL FIELD

The present invention relates to a liquid applicator which stores an application liquid such as liquid rouge, nail polish and the like and appropriately feeds the applying part by means of a liquid squeezing mechanism.

BACKGROUND ART

As conventional examples of liquid applicators of this kind, configurations shown in FIGS. 20 and 21 have been known.

In a liquid applicator X shown in FIG. 20, an outer sleeve 41*a* serving as a rotary actuator 41 is permitted to rotate in one direction only with respect to a main part 42 by means of a ratchet mechanism 40 that consists of an engaging pawl 40*a* and ratchet teeth 40*b*, and as outer sleeve 41*a* is rotated relative to main part 42, an inner sleeve 41*b* rotates together with outer sleeve 41*a*. At the same time, a screw rod 43, which is stopped from rotating by an insertion hole 44, relatively rotates with respect to rotary actuator 41 and moves forwards by virtue of screw-mating with a female thread 45, and causes a piston 46 to move forwards. As a result, application liquid L stored in an application liquid reservoir 42*a* of main part 42 is pushed out towards an applying part 48 by way of a pipe-like feeder 47 and impregnates applying part 48 so as to provide application. In FIG. 20, 49 designates a cap element.

Concerning an applicator Y shown in FIG. 21, as a rotary actuator 50 is rotated, a male thread rod 51 turns, so that a pressing sleeve 52 that is screw fitted with the rod, moves forwards along a groove 53. As a result, a piston 54 which is located at that front end moves forwards so as to push out an application liquid L stored in a main part 55 towards an applying part 57 by way of a pipe-like feeder 56 and impregnates applying part 57 so as to provide application. In the above way, since the conventional liquid applicators X and Y are constructed so that rotational movement of rotary actuator 41 or 50 is transformed into a linear motion of piston 46 or 54 whereby application liquid L is supplied, it is possible to make a delicate adjustment of the supplied amount and hence it is possible to properly and easily achieve application work. In FIG. 21, 58 designates a cap element.

However, there is a problem with these liquid applicators X and Y. That is, when the viscosity of the application liquid stored in main part 42 or 55 is 500 mPa·s or below, the application liquid is liable to leak out into cap 49 or 58 due to external force such as being dropped or vibrated during transportation, during usage of the applicator and from other causes.

On the other hand, Japanese Patent Application Laid-open Hei 11 No.20375 discloses an applicator Z which, as shown in FIG. 22, is comprised of a barrel cylinder made of a flexible material which is pressing deformable and capable of returning to its original shape, forming an application liquid reservoir 60 therein and an applying part 61 attached to the front opening of the barrel cylinder, so that the application liquid L is fed from application liquid reservoir 60 to the applying part by increasing the pressure therein by pressing. In this applicator, disposition of an application liquid supply regulator 62 made of a fabric element, a molding shape having a longitudinal passage hole therein or the like, between applying part 61 and application liquid reservoir 60, provides a pressure interfering function so that the amount of ejection of the application liquid becomes unlikely to change even though there occurs variation in pressed deformation (pressing force) acting on the application liquid reservoir 60 forming the rear barrel and hence variations in the amount of pressing. Accordingly, this applicator is known to be able to be used easily by an unskilled user (Japanese Patent Application Laid-open Hei 11 No.20375). In FIG. 22, 63 designates an application liquid absorber and 64 designates a cap element.

The application liquid supply regulator 62 of this applicator Z is to regulate the variation of the amount of pressing depending on the strength of the pressed deformation (pressing force), but this application liquid supply regulator still has the problem that delicate adjustment of the supplied amount of the application liquid cannot be achieved hence proper and easy application cannot be done. Further, this applicator Z is not aimed at preventing leakage of an application liquid having a viscosity of 500 mPa·s or lower due to being dropped or vibrated, which is the object of the present invention, but is aimed at regulating application liquid supply depending on the strength of the pressed deformation (pressing force), and also has the drawback that an application liquid having a viscosity of 200 mPa·s or greater is difficult to supply to the applying part and hence achieve easy application.

DISCLOSURE OF INVENTION

In view of the above conventional problems and the like, the present invention is to solve the problems, it is therefore an object of the present invention to provide a liquid applicator which can prevent leakage of the application liquid into the cap due to being dropped or vibrated during transportation, during usage of the liquid applicator and from other causes even when an application liquid having a viscosity of 30 mPa·s to 500 mPa·s is used, and which can make fine control of the supplied amount of the application liquid possible and can realize proper and easy application work.

The present inventor has eagerly studied the above conventional problems, and has finally succeeded in obtaining a liquid applicator meeting the above object, which includes: a main part storing an application liquid having a viscosity of 30 mPa·s to 500 mPa·s; a liquid squeezing mechanism attached to the main part whereby the application liquid is supplied to an applying part; and an application liquid feeder having a particular configuration disposed between the applying part and the main part, thus completing the present invention.

That is, the present invention is configured by the following aspects:-

To being with, the first aspect of the present invention resides in a liquid applicator having a predetermined applying part at the front end of a cylindrical main part, wherein a liquid squeezing mechanism attached to the main part is caused to push an application liquid having a viscosity of 30 mPa·s to 500 mPa·s stored in the main part, forwards so as to feed applying part, characterized in that an application liquid feeder also serving as a liquid leakage preventing structure is arranged between the applying part and the main part.

Next, the second aspect of the present invention resides in the liquid applicator having the above first feature, wherein the application liquid feeder has three or more projections, in cross section, protruding from the inner wall surface thereof toward the center.

Further, the third aspect of the present invention resides in the liquid applicator having the above first feature, wherein the applying part is configured of a brush-like element which is made up of lots of bristles bounded at one end.

Furthermore, the fourth-aspect of the present invention resides in the liquid applicator having the above second feature, wherein the applying part is configured of a brush-like element which is made up of lots of bristles bounded at one end.

BEST MODE FOR CARRYING OUT THE INVENTION

Referring to FIGS. 1 to 19, the embodiment of a liquid applicator according to the present invention will be described.

Figure 1:
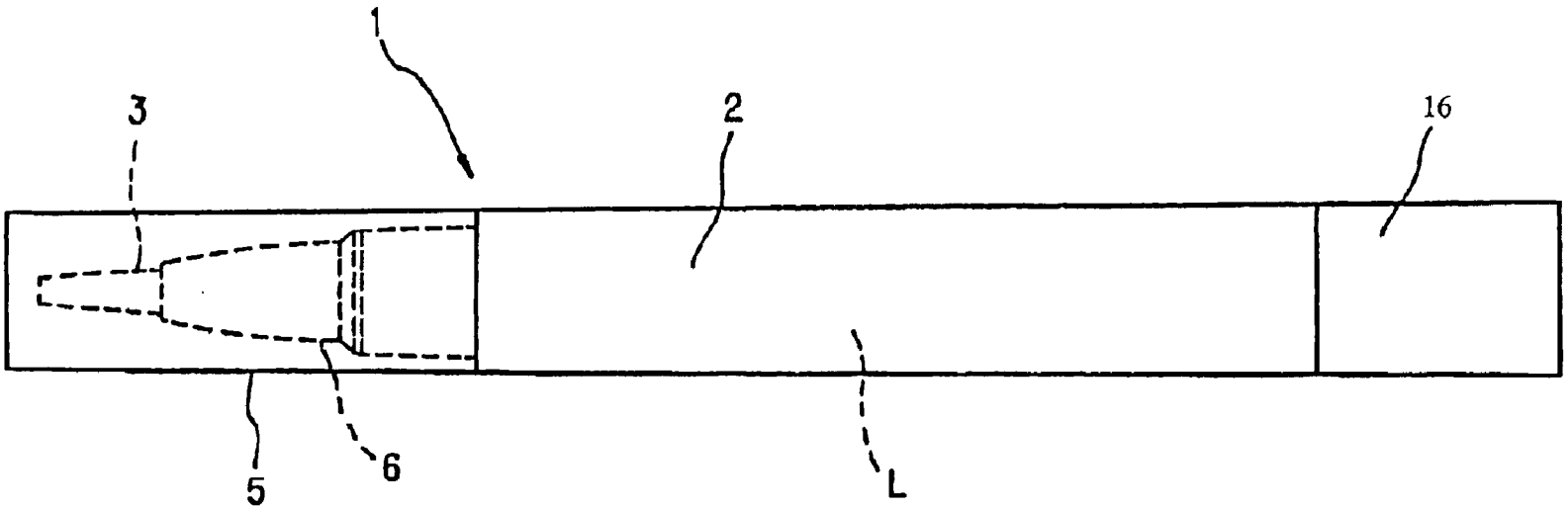
FIG. 1 is a side view showing an example of the overall configuration of one embodiment of a liquid applicator according to the present invention.

FIG. 1 is a side view showing an external configuration of the embodiment of the present invention.

As shown in FIG. 1, a liquid applicator 1 of this embodiment is comprised of a hollow cylindrical main part 2 storing an application liquid L therein, having a viscosity of 30 mPa·s to 500 mPa·s (at 25, omitted hereinbelow), an applying part 3 fitted at the front end of this main part 2; a liquid squeezing mechanism 4 for squeezing the application liquid L to the applying part 3 in front; and a cap 5 covering the applying part 3. This liquid squeezing mechanism 4 is composed of a fixed sleeve 11, an advance part 12, a screw rod 13 and a piston 14, which will be described later.

Figure 2:
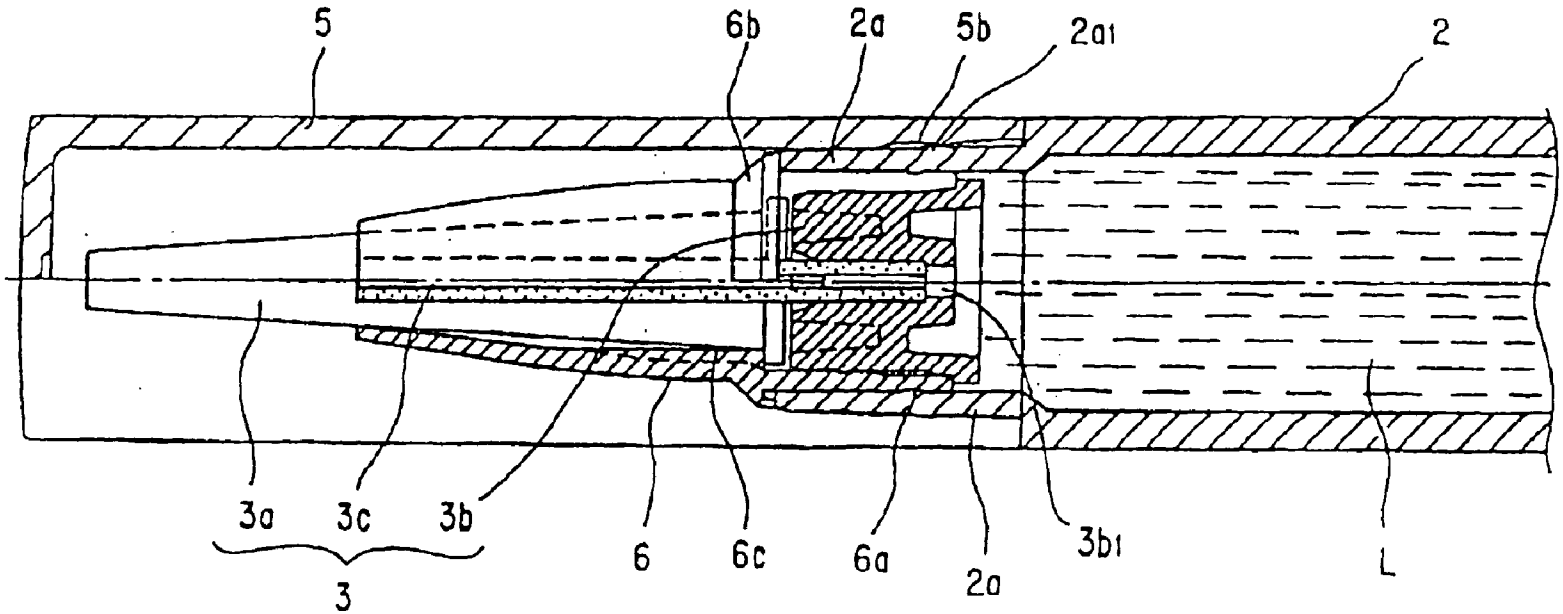
FIG. 2 is a vertical side sectional view showing the front half of that shown in FIG. 1.

The main part 2 has a shape and configuration shown in FIGS. 2 to 6. Specifically, main part 2 has a cylindrical shape having a small-diametric portion 2*a* at its front having approximately the same outside diameter as the inside diameter of the cap 5 so that the cap 5 can be fitted thereon. As shown in FIG. 2, formed on the outer peripheral surface of small-diametric portion 2*a* is a projected portion 2*a*1 mating a recessed portion 5*a* formed on the inner surface of the cap 5, so that mating between the recessed portion 5*a* and projected portion 2*a*1 will prevent cap 5 from accidentally dropping off from small-diametric portion 2*a*.

Figure 3:
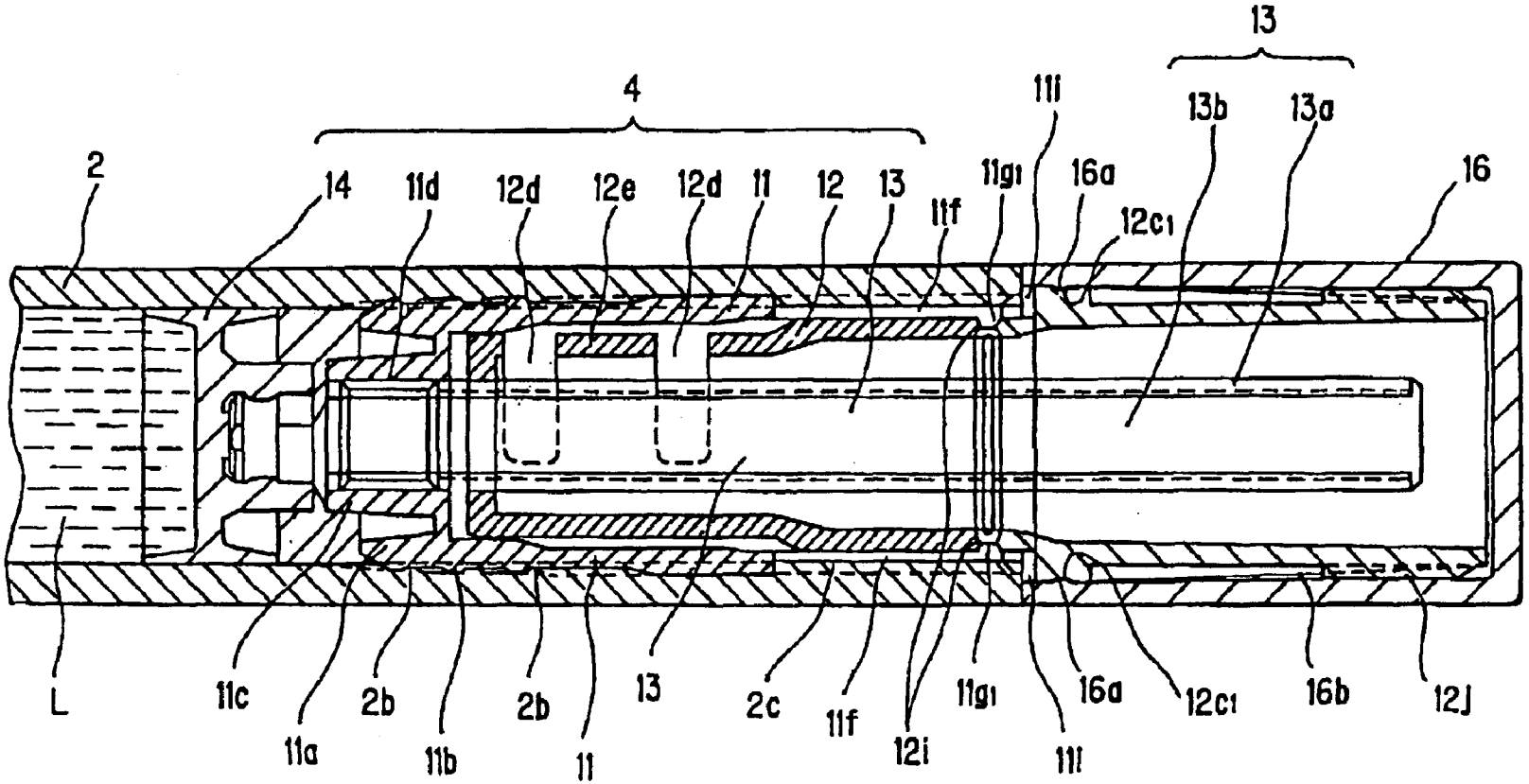
FIG. 3 is a vertical side sectional view showing the rear half of that shown in FIG. 1.
Figure 4:
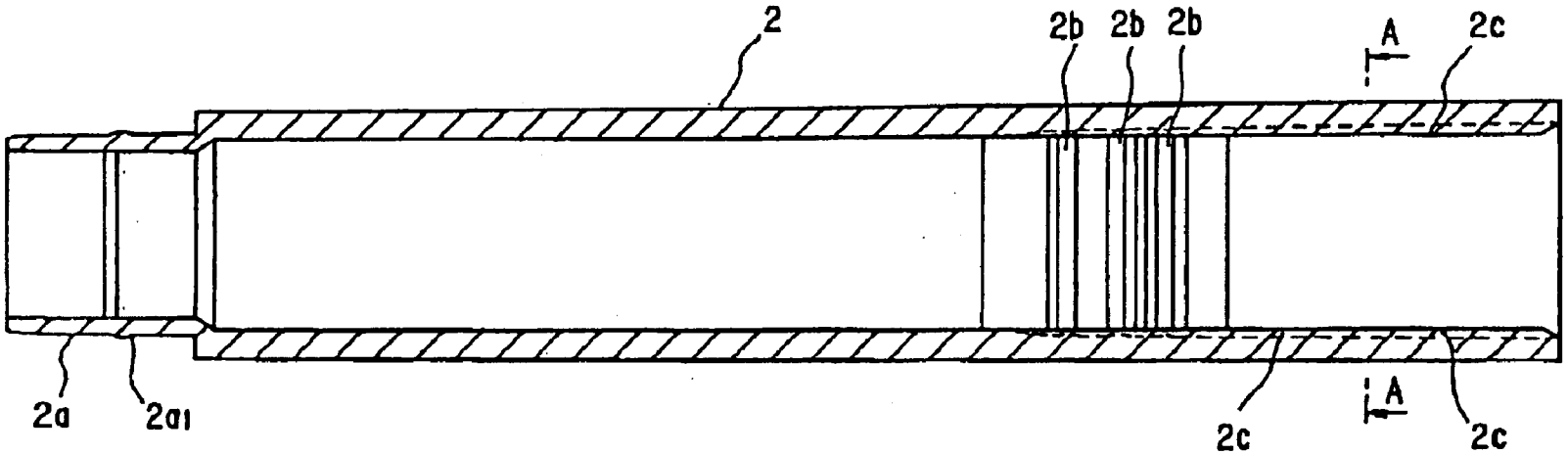
FIG. 4 is a vertical side sectional view showing the main part of that shown in FIGS. 2 and 3.
Figure 5:
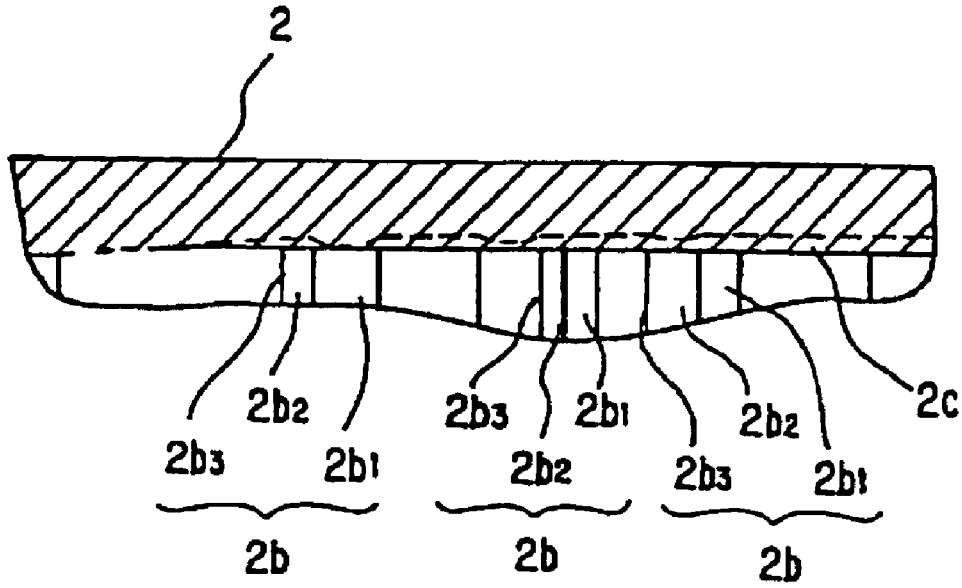
FIG. 5 is an enlarged view showing the projected 2*b* portion of FIG. 4.

Further, a projected portion 6*a* is formed on the inner surface of small-diametric portion 2*a* when engaged with an aftermentioned front barrel 6 while a multiple number of projected portions 2*b* are formed on the inner surface at the rear part of the main part 2, as shown in FIGS. 3 and 4. As shown in FIG. 5, each projected portion 2*b* is composed of a gentle slope 2*b*1 which gradually ascends inwardly from rear to front, a flat portion 2*b*2 contiguous to this slope 2*b*1 and a steep slope 2*b*3 which suddenly outwardly descends, approximately perpendicularly from this flat portion 2*b*2. These projected portions are used to engage fixed sleeve 11 when it is squeezed therein.

Figure 6:
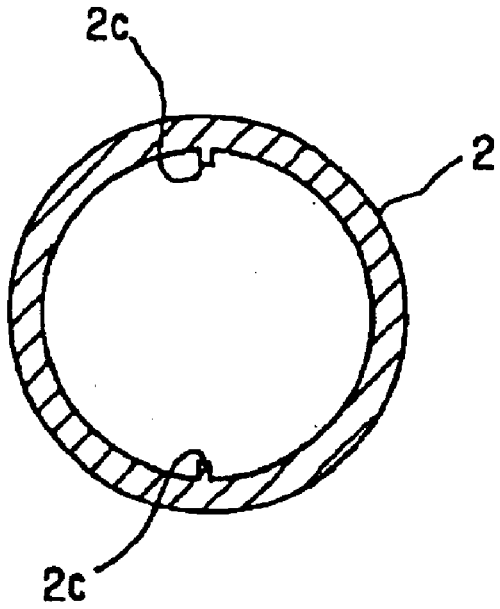
FIG. 6 is a sectional view cut along a plane A—A in FIG. 4.

As shown in FIG. 6, which is an enlarged view cut along a plane A—A in FIG. 4, a pair of ribs 2*c* extending in the longitudinal direction from the rear end to the front of the projected portions 2*b* are formed on the inner peripheral surface of the main part 2.

Figure 7:
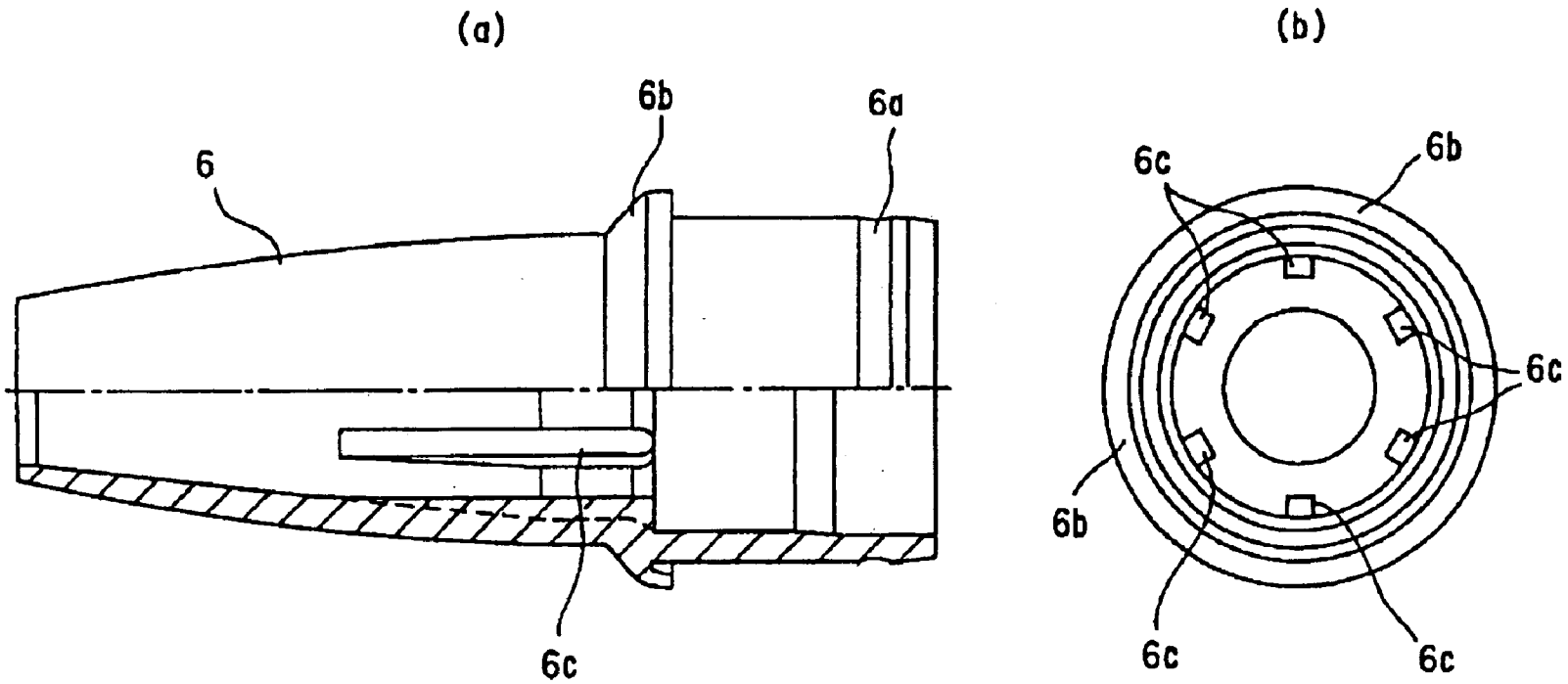
FIG. 7(*a*) is a vertical side sectional view showing part of a front barrel shown in FIG. 3, and FIG. 7(*b*) is a rear view of (*a*)

FIG. 7 shows the shape of the front barrel 6. This front barrel 6 is formed of a tapered sleeve which becomes smaller in diameter toward its front end and has an annular mating recess 6*a* formed on the outer periphery in the rear end. This mating recess 6*a* is mated by press fitting with an annular mating projection 2*a*1 formed on the inner periphery of small-diameter portion 2*a* of the main part 2 so as to prevent it from dropping from front barrel 6. A flange 6*b* is formed on the outer periphery of the front barrel 6. This flange 6*b* abuts the front end face of the small-diametric portion.

Further, a multiple number (six, in this case) of ribs 6*c* extending in the front-to-rear direction are formed on the inner surface of the front barrel 6, so that the rear part of applying part 3 (see FIG. 8) is held by these ribs 6*c*.

Figure 8:
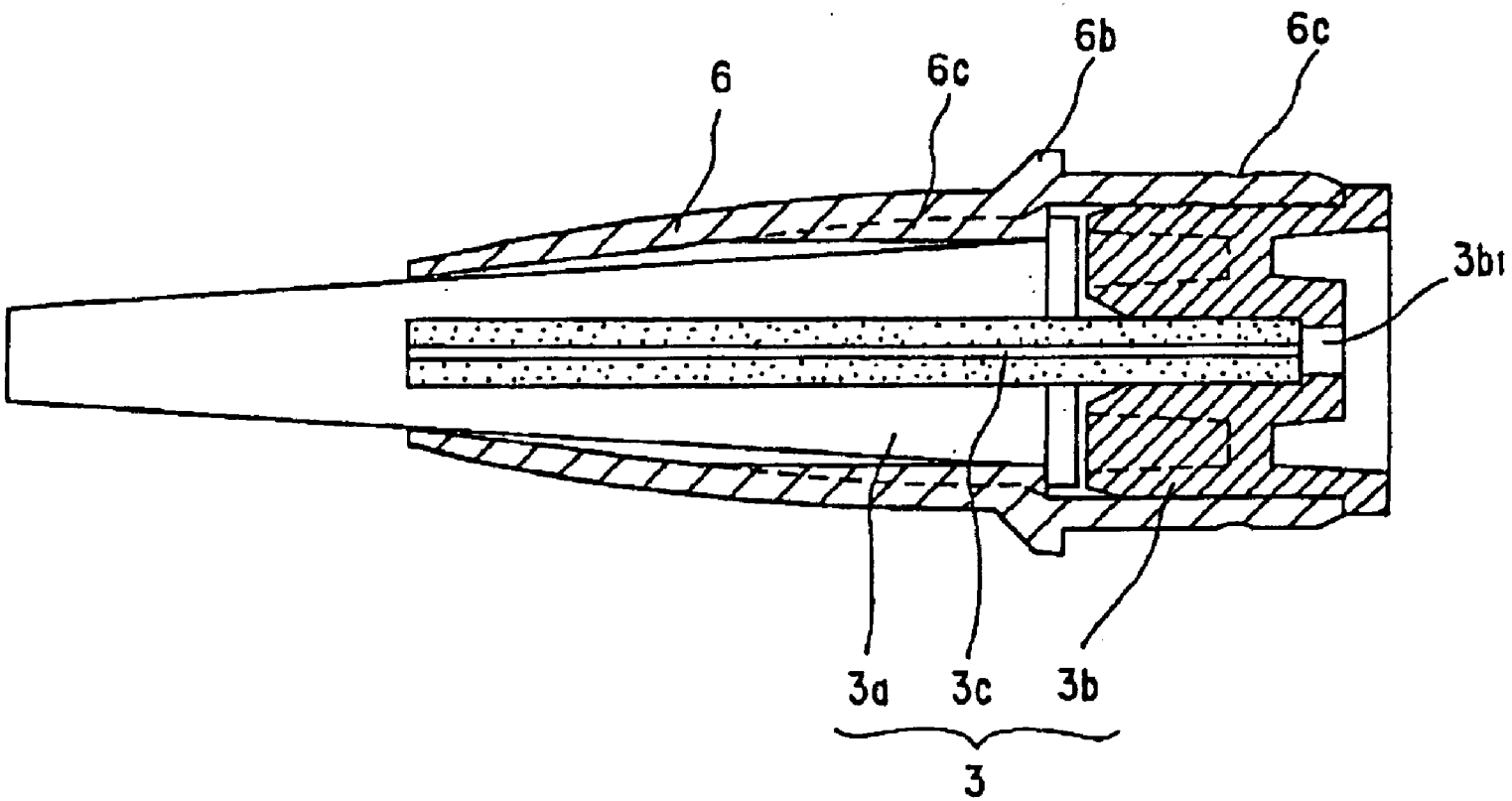
FIG. 8 is a vertical side sectional view showing a front barrel and an applying part shown in FIG. 3.

The applying part 3 in this embodiment is composed of, as shown in FIG. 8, a brush-like part 3*a* having lots of resin bristles bounded at the rear end by hot fusing, an annular holder 3*b* press fitted to the inner face of the front barrel 6, an application liquid feeder 3*c* which is inserted and fixed to a passage hole 3*b*1 at the center of this holder 3*b*, extending from the center of the rear end of the brush-like part 3*a* to the middle portion (the front end of front barrel 6) and serving as a liquid leakage preventing structure.

The application liquid feeder, also serving as a liquid leakage preventing structure, is not necessarily inserted into brush-like part 3*a*, but is preferably inserted about 0 to 15 mm or more preferably 0.5 to 10 mm, therein, depending on the physical properties of the application liquid, such as viscosity, surface tension, for example.

Figure 9:
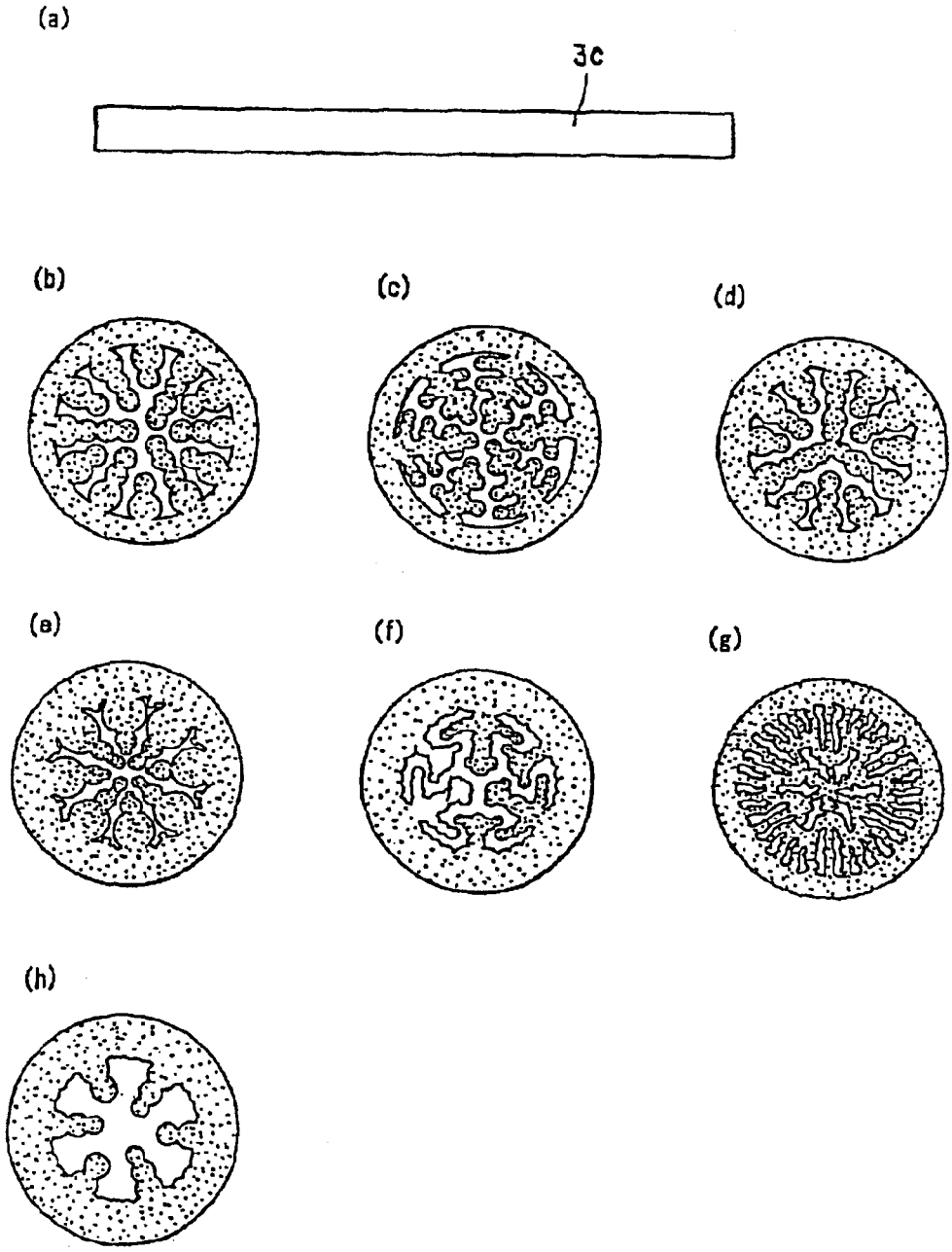
FIG. 9(*a*) is a side view showing an application liquid feeder also serving as a liquid leakage preventing structure, and FIGS. 9(*b*) to (*h*) are sectional views showing a variety of specific configurations.

This application liquid feeder 3*c* also serving as a liquid leakage preventing structure has a shape shown in FIG. 9(*a*) and can be a plastic molding made of, for example, one of polyacetal resin, acrylic resin, polyester resin, polyamide resin, polyurethane resin, polyolefine resin, polyvinyl resin, polycarbonate resin, polyether resin, polyphenylene resin and the like, or combination of two or more of these, and having three or more projections (in cross section) protruding inwards to the axis from the inner wall surface thereof.

Specific examples of the cross sections of application liquid feeder 3*c* also serving as the liquid leakage preventing structure include configurations shown in FIGS. 9(*b*) to (*h*), but any shape is applicable as long as it has three or more projections extending from the inner wall surface to the center. The sectional configuration and dimensions should be determined depending on the physical properties of the application liquid, such as viscosity, surface tension, for example.

The fixed sleeve has the configuration shown in FIGS. 10 to 14.

Formed on the outer periphery of the front half of fixed sleeve 11 are a plurality of projected portions 11*b* which can be press fitted into recessed and projected portions 2*b* of the main part 2. Each projected portion 11*b* is composed of a gentle slope 11*b*1 which gradually projects outwardly from front to rear, conversely to the configuration of projected portion 2*b* of the main part 2, a flat portion 11*b*2 continuous to the top of gentle slope 11*b*1 and a steep slope 11*b*3 which suddenly inwardly descends, approximately perpendicularly from this flat portion 11*b*2. Each steep slope 11*b*3 abuts corresponding steep slope 2*b*3 of the projected portion 11*b* of the main part 2 so as to prevent it from coming off from main part 2.

Figure 10:
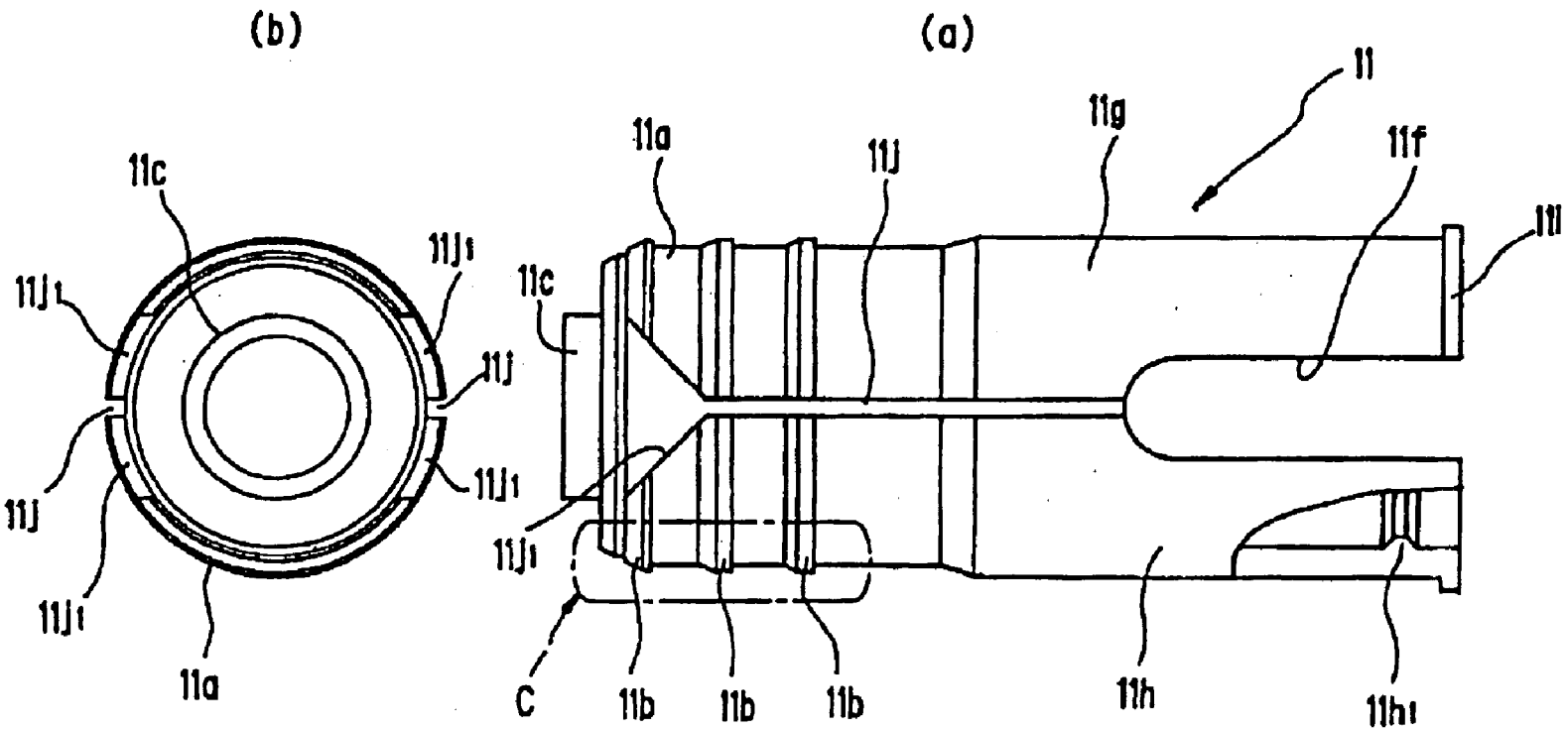
FIG. 10 is a view showing a fixed sleeve in FIG. 3, FIG. 10(*a*) being a plan view and FIG. 10(*b*) being a front view of (*a*), FIG. 11(*a*) is a vertical side sectional view showing that shown in FIG. 10 and FIG. 11(*b*) is a rear view showing that shown in FIG. 7.
Figure 11:
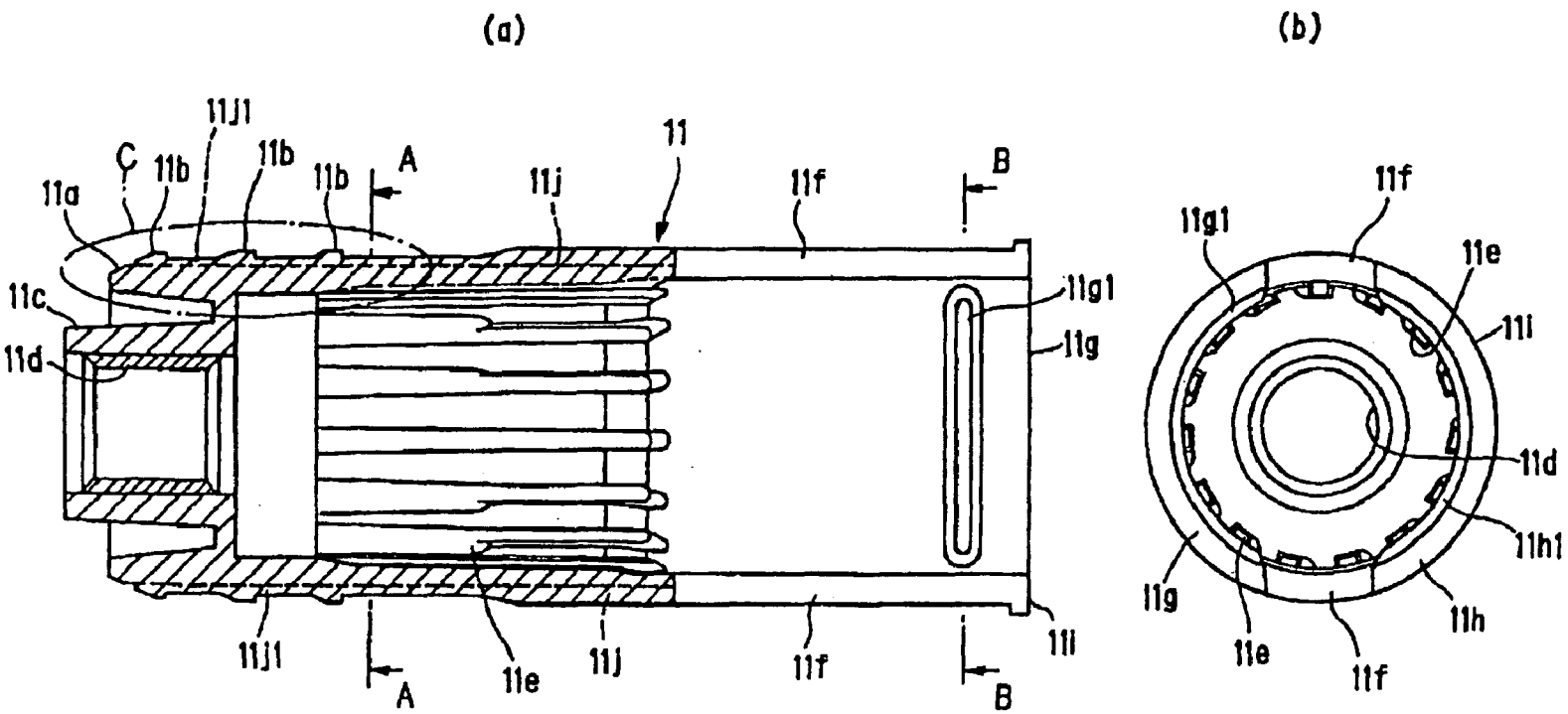
Figure 12:
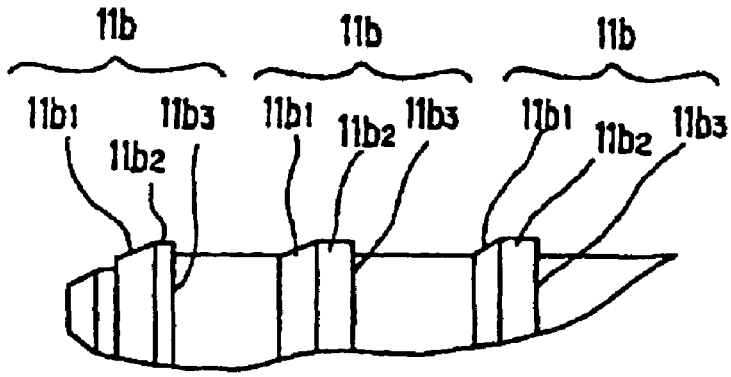
FIG. 12 is an enlarged view showing the C-portion of FIG. 10.
Figure 13:
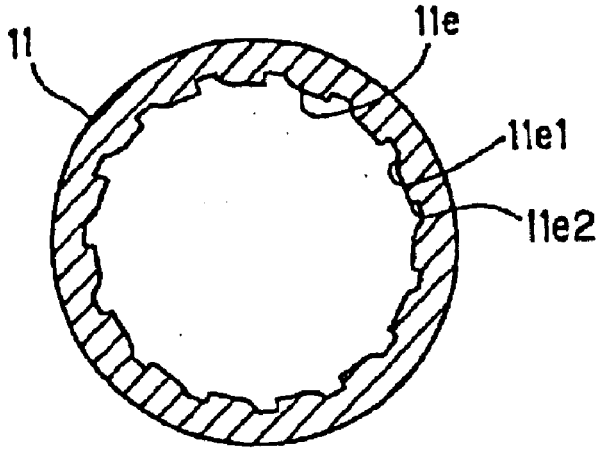
FIG. 13 is a sectional view cut along a plane A—A in FIG. 11(*a*)
Figure 14:
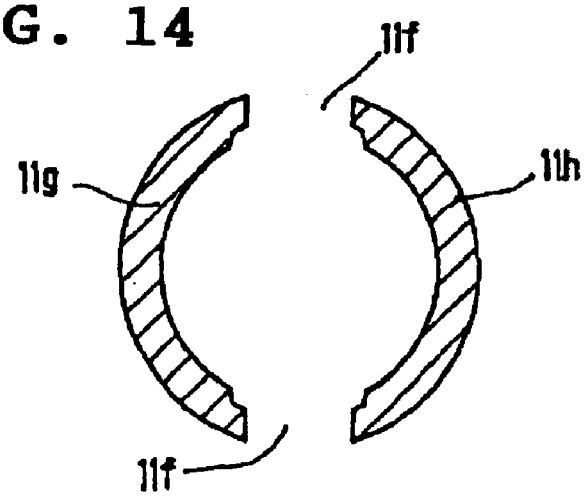
FIG. 14 is a sectional view cut along a plane B—B in FIG. 11(*a*)
Figure 15:
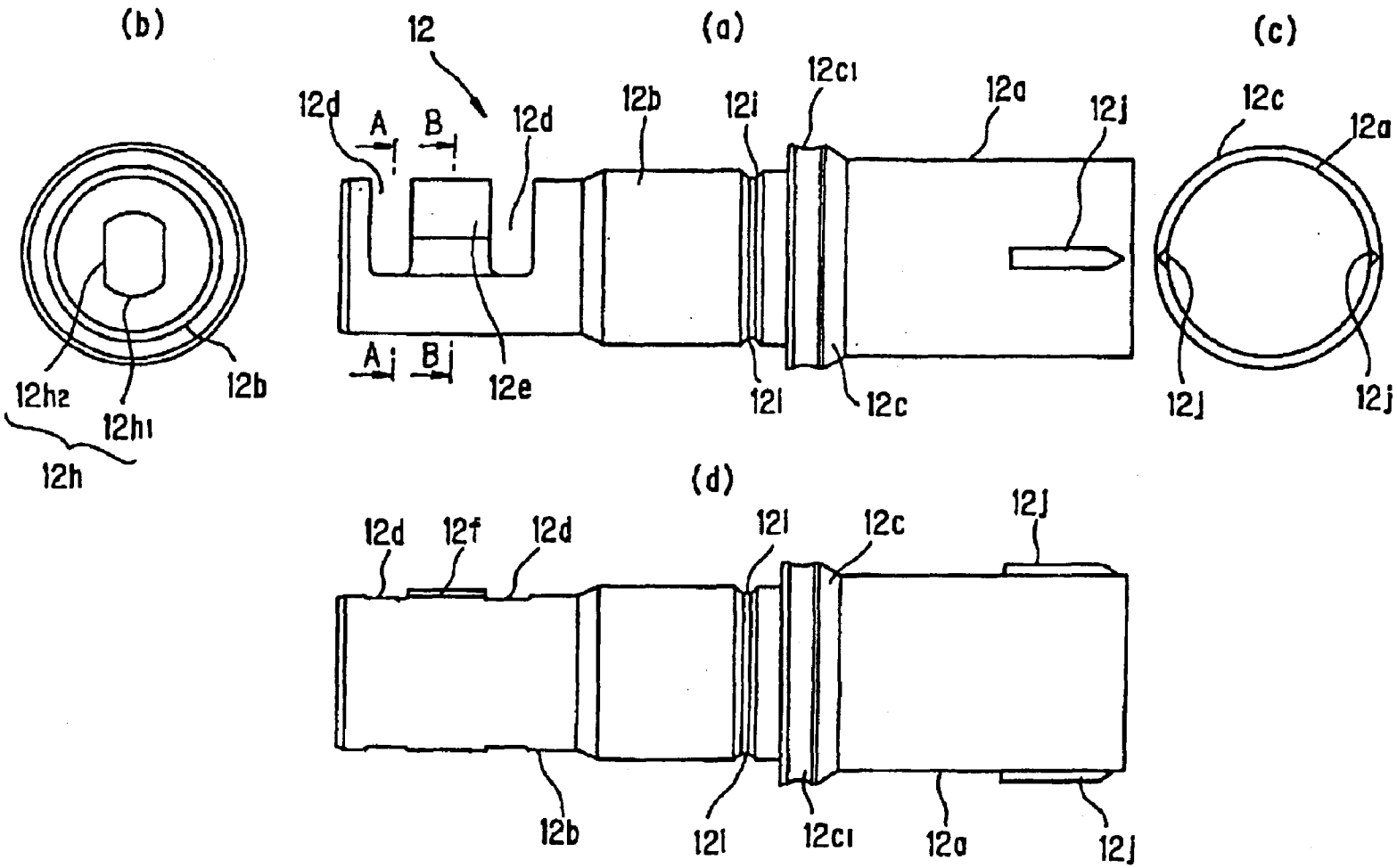
FIG. 15 is a view showing the shape of an advance part shown in FIG. 3, FIG. 15(*a*) being a side view, FIG. 15(*b*) a front view, FIG. 15(*c*) a rear view and FIG. 15(*d*) a bottom view.
Figure 16:
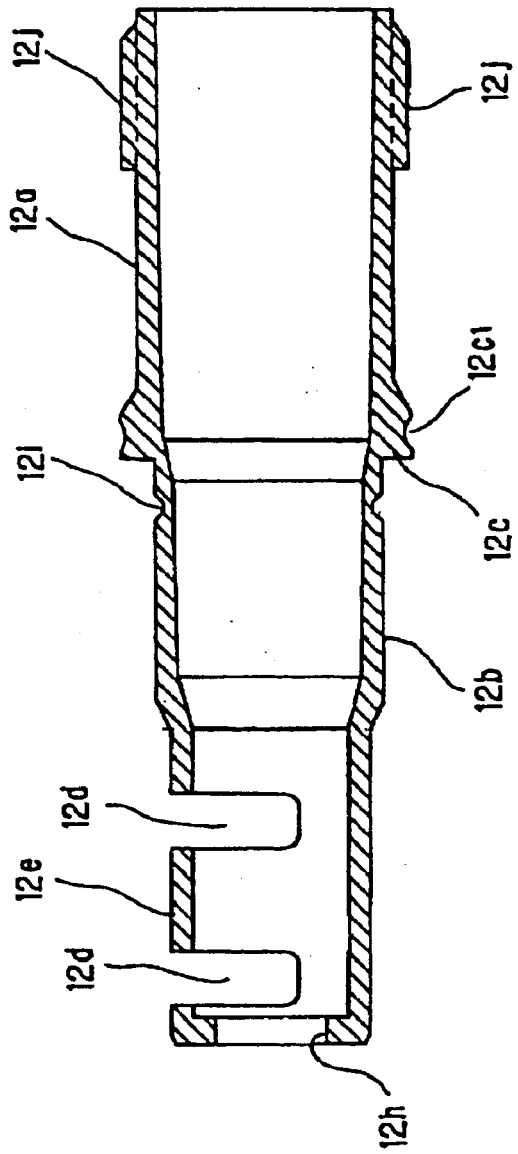
FIG. 16 is a vertical side sectional view showing that shown in FIG. 15(*a*)

The front end part of fixed sleeve 11 has a double cylindrical configuration of an outer sleeve 11*a* having the above-described projections and an inner sleeve 11*c* therein (see FIG. 10(*b*)). The inner surface of inner sleeve 11*c* is formed with a female thread 11*d*, as shown in FIG. 11(*a*). Further, a lot of cam grooves lie forming a saw-toothed cross section are formed on the inner surface of the middle portion of fixed sleeve 11, as shown in FIGS. 11(*b*) and 13.

The rear half of the fixed sleeve 11 is bifurcated into a pair of legs 11*g* and 11*h*, each having a cylindrical partial side, defined by a pair of slits 11*f* vertically arranged opposing to each other, as shown in FIGS. 11(*b*) and 14. An arc flange 11*i* projected outwards is formed on the outer peripheral side at the rear end of each leg 11*g*, 11*h* while an arc mating projection 11*g*1, 11*h*1 is projectively formed on the inner surface of each leg 11*g*, 11*h*. These mating projections 11*g*1 and 11*h*1 abut the rear end face of the main part 2. A anti-rotational groove 11*j* is incised on the outer periphery of fixed sleeve 11 from the interior most of each of the aforementioned slits 11*f* to the front end, so that the aforementioned ribs 2*c* of main part 2 fit into these anti-rotational grooves 11*j*. The front part, designated at 11*j*1, of this anti-rotational groove 11*j*, is formed to spread open forwards with a predetermined angle.

In this way, engagement between steep slopes 11*b*3 of fixed sleeve 11 with steep slopes 2*b*3 of main part 2 prevents the fixed sleeve 11 from moving rearwards with respect to main part 2 while engagement of ribs 2*c* with anti-rotational grooves 11*j* prevents rotation of the fixed sleeve with respect to main part 2. Abutment of flanges 11*j* onto the rear end of main part 2 prevents forward movement of the fixed sleeve relative to main part 2. Thus, the fixed sleeve can be fixed fast to main part 2.

FIGS. 15 to 18 are views showing the aforementioned advance part 12.

This advance part 12 is integrally formed of a cylindrical projected portion 12*a* to be fitted around the main part 2 and a cylindrical insert portion 12*b* to be inserted into main part 2. The projected portion 12*a* is formed with an annular flange 12*c* which has an concave rounded surface 12*c*1 on its peripheral side. The front end face of the insert portion 12*b* is formed with an insert hole 12*h* defined by circular portions 12*h*1 and straight portions 12*h*2. A U-shaped slit 12*d* is formed on the front peripheral side of insert portion 12*b*, so that the portion enclosed by this slit 12*d* forms a cantilevered spring-like elastic piece 12*e*.

Figure 17:
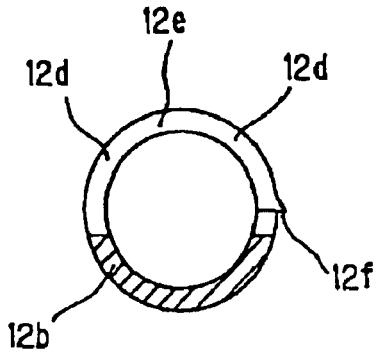
FIG. 17 is a sectional view cut along a plane A—A in FIG. 15(*a*)
Figure 18:
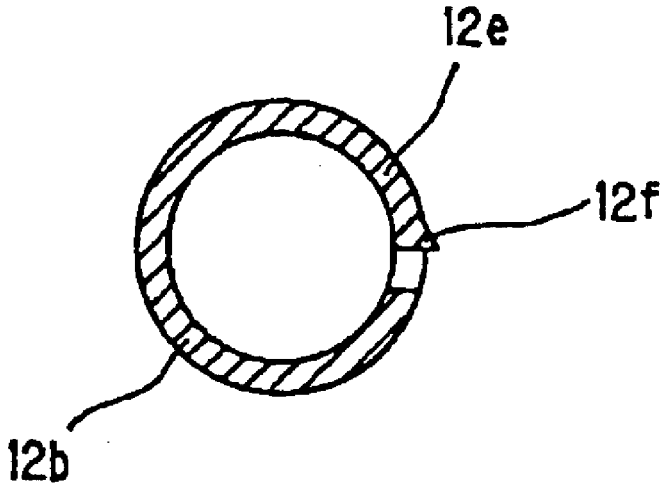
FIG. 18 is a sectional view cut along a plane B—B in FIG. 15(*a*)

This elastic piece 12*e* has at its distal end a cam portion 12*f* having a sectional shape of an acute projection bent outwards, as shown in FIGS. 17 and 18. This cain portion 12*f* is engaged with the aforementioned cam groove 11*e*. Further, an annular mating recess 12*i* is formed in the rear part of the insert portion 12*b*. This mating recess 12*i* receives mating projections 11*g*1 and 11*h*1 projected from legs 11*g* and 11*h* of the fixed sleeve 11. In this way, advance part 12 is prevented from moving back and forth and is permitted to rotate with respect to fixed sleeve 11.

Figure 19:
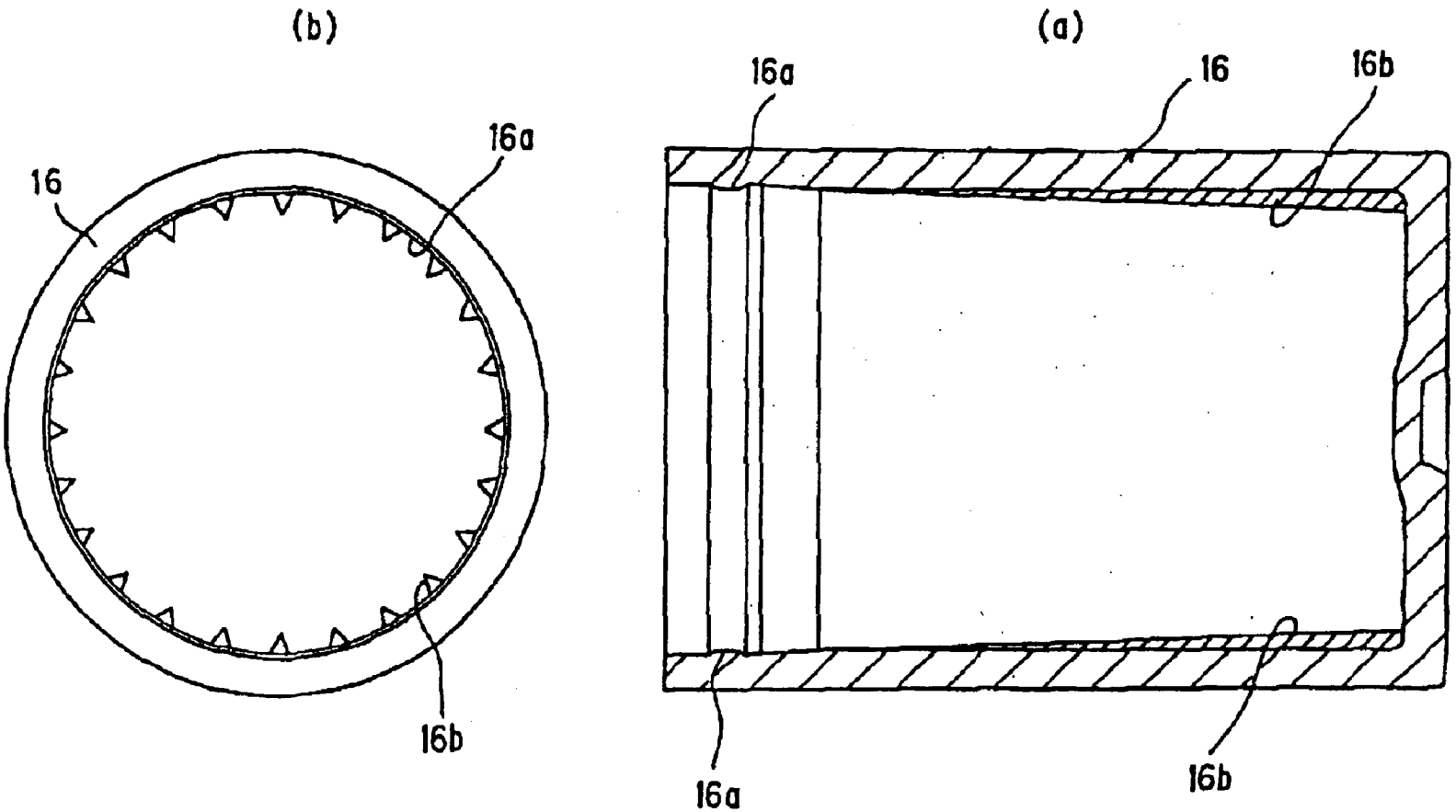
FIG. 19(*a*) is an enlarged vertical side sectional view showing a crown shown in FIG. 3 and FIG. 19(*b*) is a front view of (*a*)
Figure 20:
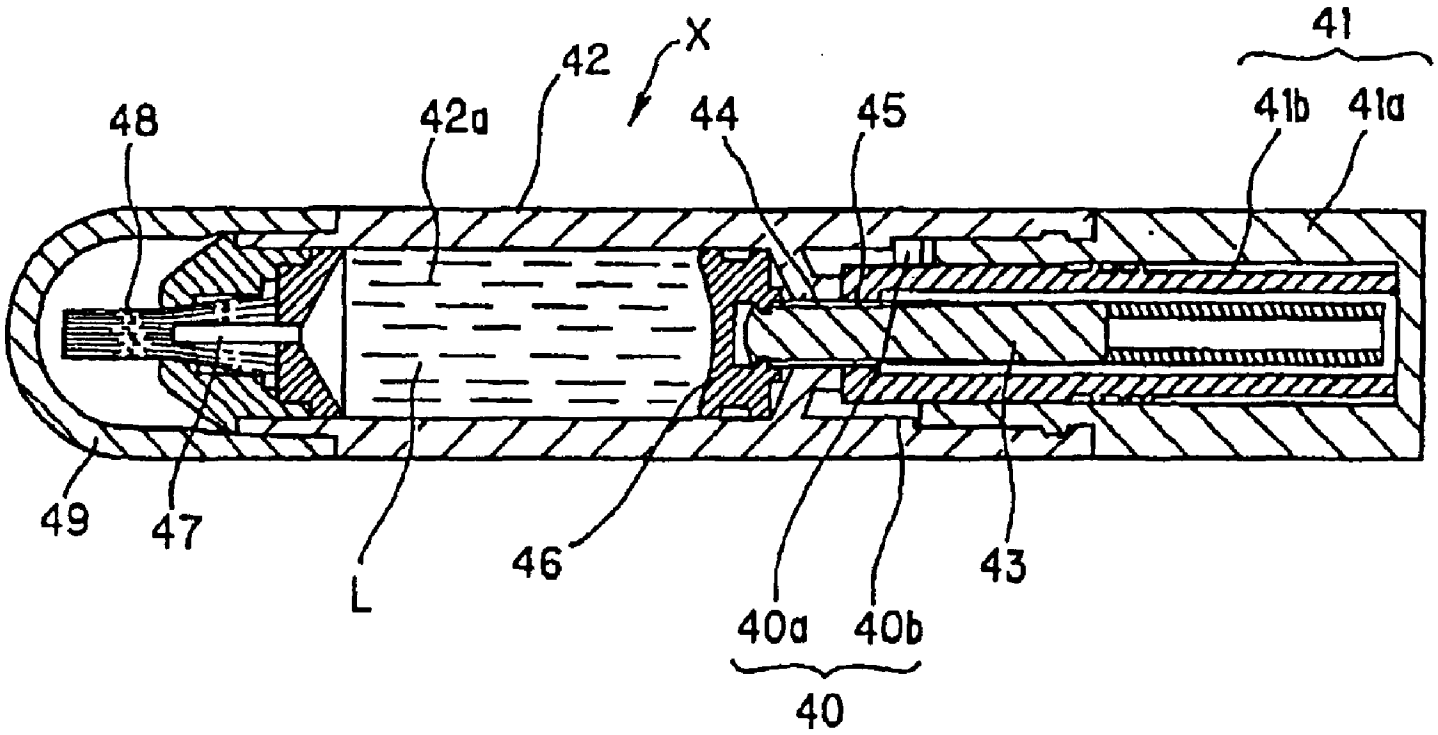
FIG. 20 is a vertical side sectional view showing an example of a conventional liquid applicator.
Figure 21:
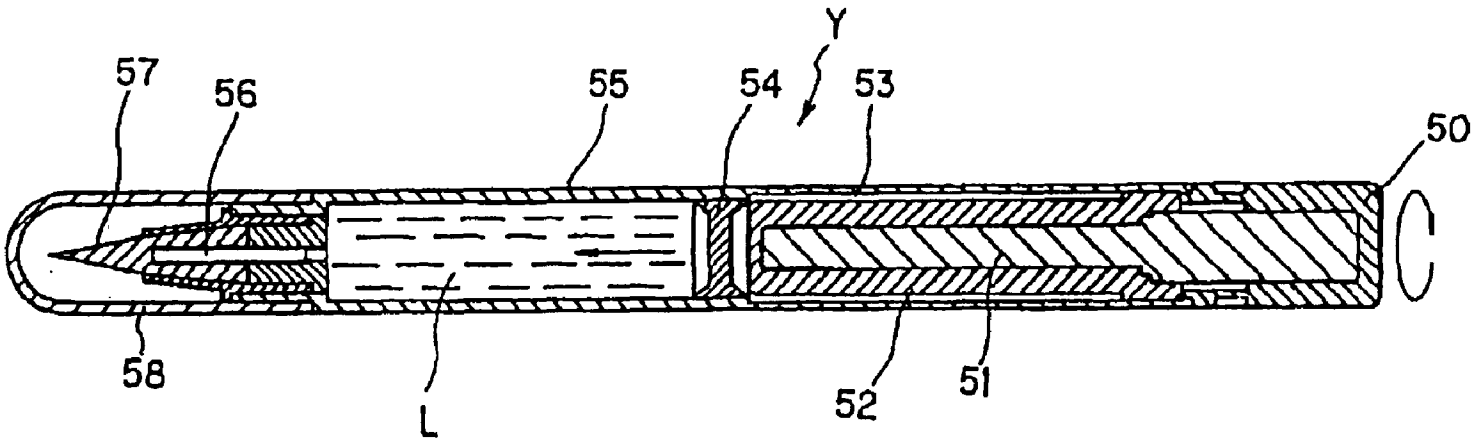
FIG. 21 is a vertical side sectional view showing another example of a conventional liquid applicator.
Figure 22:
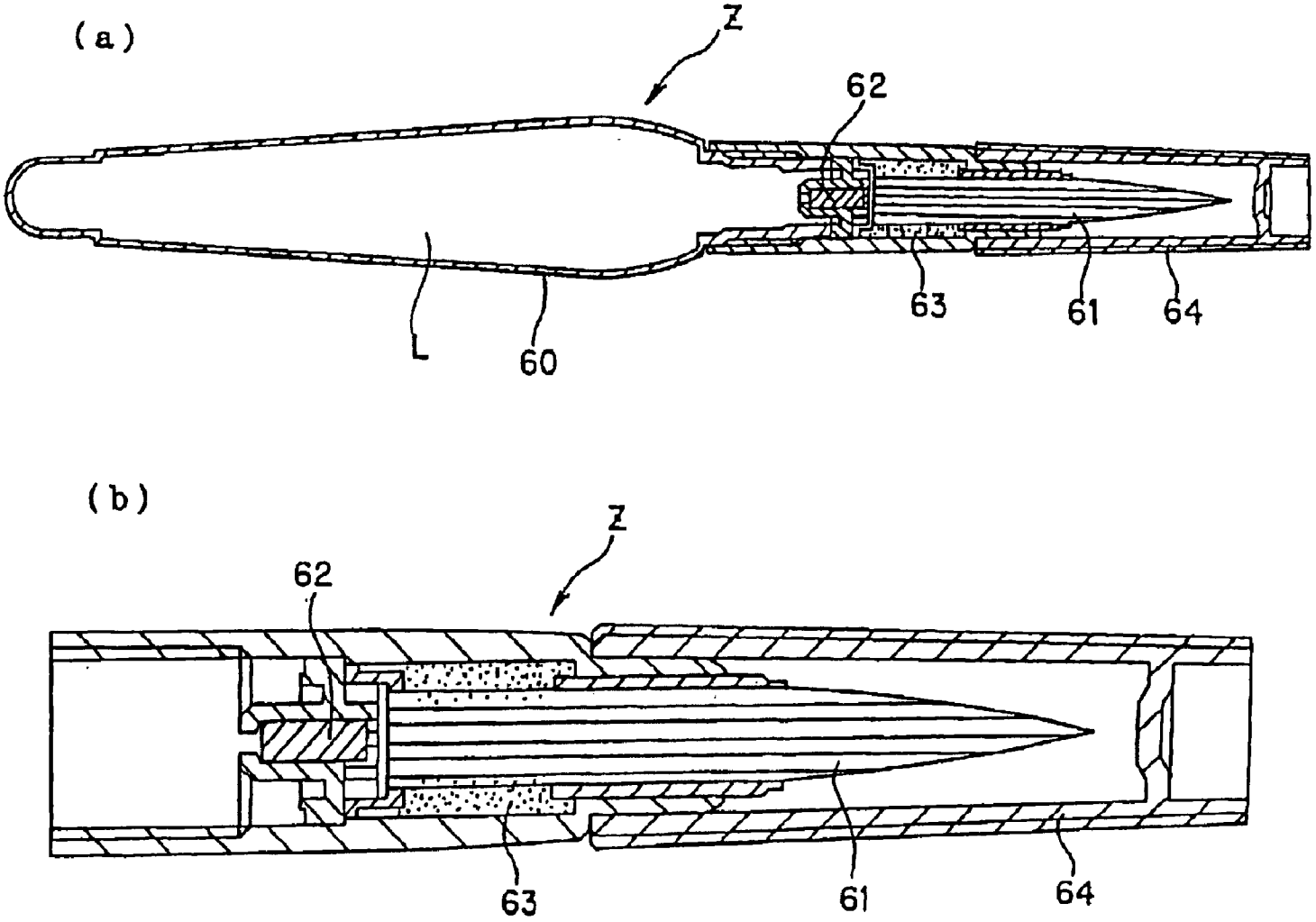
FIG. 22 is a vertical side sectional view showing a still another example of a conventional liquid applicator.

A pair of engaging projections 12*j* having a triangular section are formed 180° apart from each other on the outer peripheral surface at the rear part of projected portion 12*a* of the advance part 12. Further, a cylindrical crown 16 as shown in FIG. 19 is fitted on the outer peripheral surface of this advance part 12. This crown 16 is formed with annular projection 16*a* on the inner surface near the front end so that this annular projection 16*a* will fit the concave rounded surface 12*c*1 of flange 12*c* of the advance part 12 to thereby prevent its dropping from advance part 12. Further, many engaging projections 16*b* having a triangular cross-section are formed on the inner peripheral surface of crown 16, a predetermined distance apart from one another. Engaging projections 12*j* of the advance part 12 are inserted between engaging projections 16*b* so that abutment between engaging projections 12*j* and 16*b* enables crown 16 and advance part 12 to rotate in an approximately integral manner. Here, in this embodiment, crown 16 and projected portion 12*a* of advance part 12 constitute a rotary actuator.

Inserted into deformed insert hole 12*h* formed at the front face of the advance part 12 is a screw rod 13 having a deformed section of approximately the same shape as the insert hole. This screw rod 13 comprises a pair of male-threaded portions 13*a* formed on the cylindrical surfaces and flat portions 13*b* between the pair of male-threaded portions 13*a*, and is inserted through the insert hole 12*h* in such a manner that it can move in the longitudinal direction and will not rotate. A piston 14 is fitted to the front end of this screw rod 13. This piston 14 is provided so as to be able to slide along the inner surface of the main part 2 while maintaining fluid-tight sealing.

For assembly of liquid applicator 1 having the above configuration, assembly of application liquid squeezing mechanism 4 is carried out first outside the main part 2, as follows:-

Screw rod 13 is screwed into female threaded portion 11*d* of fixed sleeve 11, up to a predetermined position. Then, piston 14 is press fitted to the front end of the rod, which is projected more frontward than female threaded portion 11*d*. Next, while screw rod 13 projected more rearwards than fixed sleeve 11 is fitted into insert hole 12*h*, advance part 12 is press fitted into fixed sleeve 11 until mating projections 11*g*1 and 11*h*1 projectively formed on respective legs 11*g* and 11*h* of fixed sleeve 11 fit into the mating groove. Thereafter, crown 16 is fitted so as to cover the outer periphery of projected portion 12*a* of advance part 12 so that annular projection 16*a* of crown 16 is fitted into concave rounded surface 12*c*1 of flange 12*c* of advance part 12 to thereby fix crown 16 to advance part 12. Thus, assembly of application liquid squeezing mechanism 4 is completed.

Then, the assembled unit of application liquid squeezing mechanism 4 is inserted from the opening formed at the rear end of main part 2 with piston 14 foremost, being inserted first. In this process, ribs 2*c* of main part 2 are fitted into anti-rotational grooves 11*j* of fixed sleeve 11 while projected portions 11*b* of fixed sleeve 11 are engaged with projected portions 2*b* on the inner surface of main part 2, whereby fixed sleeve 11 is completely inserted into main part 2. At this point, the front opening rim of crown 16 is located so as to abut the rear opening rim of main part 2, thus completing insertion of application liquid squeezing mechanism 4 into main body 2.

The front part of anti-rotational groove 11*j* in this embodiment is formed to spread open to some width, so that if rib 2*c* is inserted within the range of the width, the rib 2*c* is guided by the front part of anti-rotational groove 11*j* as fixed sleeve 11 is inserted, whereby the rib is positively inserted into anti-rotational groove 11*j*. Further, since fixed sleeve 11 is formed with slits 11*f*, this makes the peripheral walls flexible, hence makes its press insertion into main part 2 easy.

Next, an appropriate amount of the application liquid is charged from the opening of small-diametric portion 2*a* formed at the front end of the main part 2, and front barrel 6 with applying element 3 fitted therein is press fitted to the inner face of small-diametric portion 2*a* of the main part 2. Then, the front barrel 6 is fixed by fitting the mating projected portion 2*a*1 formed on that inner face with mating recess 6*a* of front barrel 6. Finally, cap 5 is fitted on small-diametric portion 2*a* to complete assembly of the liquid applicator.

In this embodiment, since crown 16, main part 2 and cap 5 are formed so that their outside diameters are equal to one another, this configuration presents a stylish appearance having a relatively small-diametric cylindrical surface continuous from the front to the rear.

Thus, in this embodiment, since all the constituents for liquid squeezing mechanism 4 can be easily assembled into main part 2 by inserting them from the rear opening of main body 2, the fabrication can be simplified. Further, since liquid squeezing mechanism 4 can be assembled beforehand into a unit, outside main part 2, it is possible to improve the efficiency of the fabrication process.

In the thus constructed liquid applicator 1 of this embodiment, the application liquid can be supplied from the main part to the applying element by rotating crown 16 which is located behind main part 2, in the predetermined direction (clockwise direction). Specifically, as crown 16 is turned clockwise relative to main part 2, advance part 12 rotates in the same direction and hence screw rod 13 inserted through deformed insert hole 12*h* of this advance part 12 also rotates together. Since male-threaded portions 13*a* of this screw rod 13 are engaged with the female-threaded portion 11*d* of the fixed sleeve 11, screw rod 13 moves forwards as it is rotating clockwise by virtue of the screw-mating. As a result, piston 14 coupled at the front end of screw rod 13 moves forwards, whereby brush-like part 3*a* becomes ready to apply. Here, since the applying element 3 in this embodiment includes brush-like part 3*a*, this configuration is markedly effective for delicate drawing of application liquids having a viscosity of 30 mPa·s to 500 mPa·s, e.g. liquids for rouge, eyebrow pencil, etc.

According to the liquid applicator of the present invention, even when an application liquid L having a viscosity of 30 mPa·s to 500 mPa·s is used, application liquid L stored in main part 2 is pushed forwards by the liquid squeezing mechanism so as to feed brush-like element 3*a* through application liquid feeder 3*c*, which is arranged from the passage hole 3*b*1 of the holder 3*b* fitted in front barrel 6 and is formed with three or more inward projections therein from the inner peripheral wall so as to also serve as a liquid leakage preventing structure. Accordingly, it is possible to prevent leakage of the application liquid into the cap due to being dropped or vibrated during transportation, during usage of the liquid applicator and from other causes. Furthermore, provision of the liquid squeezing mechanism makes fine control of the supplied amount of the application liquid possible, thus realizing proper and easy application work.

Here, use of an application liquid having a viscosity greater than 500 mPa·s makes ejection of the application liquid slow, causing an unpreferred result.

The advance part 12 is so arranged that cam portion 12*f* formed at the distal part of elastic piece 12*e* continuously abuts saw-toothed cam groove 11*e* formed in main part 2, and when crown 16 is rotated, cam portion 12*f* advances over the rear part of the slope of cam groove 11*e* and then falls and abuts the front part of the next slope. This cycle is repeated every predetermined pitch of rotation of crown 16. In this case, since the elastic force of the elastic piece is repeatedly increased and released, the operator feels a clicking sensation and clicking sound arises from abutment of cam portion 12*f* with the front part of slope 11*e*1 when released. Therefore, the operator is able to know the angle of rotation of the crown or the supplied amount of application liquid L from the clicking sensation or the number of clicking sounds, hence can make easy adjustment of the supplied amount. Further, since the front part of slope 11*e*1 is formed with a curved surface (or rounded), this provides smooth feeling of advancement when cam portion 12*f* advances and climbs from the front part of slope 11*e*1 towards the middle part of it.

Further, since cam portion 12*f* of the elastic piece 12*e* always abuts an engagement face 11*e*2 of the cam groove 11*e* of fixed sleeve 11, counterclockwise rotation is prohibited by abutment between cam portion 12*f* and engagement face 11*e*2 if crown 16 is attempted to be rotated in the counterclockwise direction. Therefore, screw rod 13 will not rotate counterclockwise, hence screw rod 13 and piston 14 will never move rearward. As a result, the application liquid L having been once ejected to the outside will never return into pipe 3*c* of applying part 3 or main part 2, so that it is possible to prevent contamination by unwanted bacteria and the like into main part 2. Here, since engagement face 11*e*2 is formed to be approximately vertical, cam portion 12*f* is caught positively by engagement face 11*e*2 when tried to be rotated counterclockwise, so that a steady rotational stop feeling can be obtained.

Advance part 12 is not directly fitted to main part 2, but is fitted with annular mating projections 11*g*1 and 11*h*1 of fixed sleeve 11 that is fixed in main part 2. Therefore it is possible to freely choose the mating configuration of fixed sleeve 11 and advance part 12, depending on the required strength, without causing any influence on the shape and configuration of main part 2. Accordingly, main part 2 may be formed of a thin-walled structure in order to make it light and may be formed of a flexible and inexpensive material such as polypropylene or the like. For fixed sleeve 11, a hard material such as ABS (acrylonitrile butadiene styrene), polycarbonate, polyacetal, PBT (polybutylene terephthalate) and the like, should be used to create mating projections 11*g*1 and 11*h*1 having a relatively large protrusion while as the advance part 12, mating recess 12*i* that mate the mating projections 11*g*1 and 11*h*1 should be formed to be a relatively large depth, whereby it is possible to mate fixed sleeve 11 and advance part 12 steadily and provide high enough strength for liquid applicator 1. In this case, sink marks may occur at the forming position of mating projections 11*g*1 and 11*h*1 in fixed sleeve 11. However, since fixed sleeve 11 is not a part which is visible from the outside, the occurrence of sink marks will not give rise to any appearance problem. As the material of advance part 12, polyacetal is most preferable in terms of spring elasticity, creep resistance and fatigue resistance properties.

Since the liquid applicator of this embodiment is constructed so that the rotary actuator in the liquid squeezing mechanism for pushing the liquid paint stored in the main part to the front barrel is not directly engaged with the main part, but is engaged with the annular mating portion of the fixed sleeve which is fitted in the main body, it is possible to freely choose the mating configuration of the fixed sleeve and rotary actuator, depending on the required strength, regardless of the shape and configuration of the main part.

Moreover, since all the constituents for the liquid squeezing mechanism such as the fixed sleeve, advance part, screw rod, piston and the like can be inserted from the rear of the barrel body, assembly can be markedly easily carried out. Accordingly, the constituents can be assembled beforehand into a unit, outside the barrel body so that the unit of the liquid squeezing mechanism can be inserted together from the rear of the barrel body. Thus, this configuration makes it possible to improve the efficiency of the assembly process and permits free design of the front configuration of the main part without regards to the piston and others, providing markedly improvement in design flexibility.

Use of liquid applicator 1 of the present invention is not limited to liquid application, cosmetics such as rouge, eyebrow pencil, hairdye and others, having a viscosity of 30 mPa·s to 500 mPa·s, but can be applied to painting of application liquids such as correction fluid, adhesives, Chinese ink, coloring materials, writing ink and others, having a viscosity of 500 mPa·s or lower. Further, the shape and configuration of the applying part can be modified appropriately depending on the purpose of usage.

Next, the present invention will be further detailed with reference to an example and a comparative example. But the present invention should not be limited to the following example.

As the example and comparative example, the liquid applicator having the configuration shown in FIGS. 1 through 19 was used. The application liquid feeder also serving as a liquid leakage preventing structure, used in the example, is made from polyacetal and has a shape of 1.5 mm in outside diameter and 21 mm in length and having a cross-section shown in FIG. 9(*e*). For the comparative example, a conventional pipe-like application liquid feeder (1.2 mm(inside diameter)×21 mm(length), material: stainless steel) serving as a flow passage was used. Each application liquid feeder is inserted from the center of the rear end of brush-like part 3*a* to its middle part (the front end of front barrel 6, see FIG. 8).

As the application liquids (liquid paints), six kinds of application liquids having viscosities ranging from 30 mPa·s to 300 mPa·s as shown in the following table 1 were prepared, in an amount of 200 ml, and were charged into the main part (content 2 ml), and evaluated by the following evaluation method.

(Evaluation Method)

The liquid applicators for the example and comparative example, produced as above, being capped, were dropped from 1 m high onto a cedar board (30 cm×30 cm) with the applying part side down, and the number of drops until the liquid paint leaked out inside the cap was counted.

The result is shown in the following table 1.

TABLE 1

| Viscosity of Application Liquid | Example | Comp. Example |
|---|---|---|
| 30 mPa · s | 15 times or more | Once |
| 50 mPa · s | 15 times or more | Once |
| 60 mPa · s | 15 times or more | Once |
| 70 mPa · s | 15 times or more | 4 times |
| 200 mPa · s | 15 times or more | 7 times |
| 300 mPa · s | 15 times or more | 8 times |

As apparent from the result shown in Table 1 above, the liquid applicator using the application liquid feeder also serving as a liquid leakage preventing structure, of the present invention, has been found to be able to prevent the application liquid from leaking into the cap even when an external force such as being dropped may be applied, in comparison with the liquid applicator using a conventional pipe-like application liquid feeder.

Industrial Applicability

According to the present invention, since a liquid squeezing mechanism is used to push out the application liquid stored inside the main part forwards to feed the applying part by way of an application liquid feeder also serving as a liquid leakage preventing structure, it is possible to provide a liquid applicator which can prevent leakage of the application liquid into the cap due to being dropped or vibrated during transportation, during usage of the liquid applicator and from other causes, in comparison with the conventional pipe-like application liquid feeder, even when an application liquid having a viscosity of 30 mPa·s to 500 mPa·s is used, and which can make fine control of the supplied amount of the application liquid possible by means of the liquid squeezing mechanism and hence can realize proper and easy application work.

What is claimed is:

1. A predetermined applying part (3) at the front end of a cylindrical main part (2), wherein a liquid squeezing mechanism (4) attached to the main part (2) is caused to push an application liquid (L) having a viscosity of 30 mPa·s to 500 mPa·s stored in the main part (2), forwards so as to feed applying part (3), characterized in that an application liquid feeder (3*c*) also serving as a liquid leakage preventing structure is arranged between the applying part (3) and the main part (2), wherein the application liquid feeder (3*c*) has three or more projections, in cross section, protruding from the inner wall surface thereof toward the center.

2. The liquid applicator according to claim 1, wherein the applying part (3) is configured of a brush-like element (3*a*) which is made up of lots of bristles bounded at one end.

* * * * *